US005451176A

United States Patent [19]

Beltman

[11] Patent Number: 5,451,176

[45] Date of Patent: Sep. 19, 1995

[54] QUICK OPENING AND SELF-CLOSING CONTAINER FOR ARTICLES

[76] Inventor: Tony Beltman, Rte. 4, Box 254, Stephenville, Tex. 76401

[21] Appl. No.: 64,908

[22] Filed: May 24, 1993

[51] Int. Cl.[6] ..... A63H 3/00

[52] U.S. Cl. ..... 446/73; 446/8; 446/268; 446/395; 446/486; 206/457

[58] Field of Search ..... 446/8, 10, 12, 71–73, 446/75, 76, 80, 268, 321, 330, 337–339, 365, 388, 391, 395, 486; 220/62, 62.1; 206/0.8, 0.81, 457; 150/150, 152, 900; D9/311

[56] References Cited

U.S. PATENT DOCUMENTS

| | | | |
|---|---|---|---|
| Re. 24,166 | 6/1956 | Stiller | 150/37 |
| 739,022 | 9/1903 | O'Shea . | |
| 744,391 | 11/1903 | O'Shea . | |
| 820,067 | 5/1906 | Richardson . | |
| 2,628,169 | 2/1953 | Berthold, Jr. | 99/180 |
| 2,932,125 | 4/1960 | McAllister | 446/391 |
| 3,183,622 | 11/1962 | Frankl | 446/329 |
| 3,468,055 | 9/1969 | Hunt | 446/337 |
| 3,848,356 | 11/1974 | Wylie et al. | 446/71 |

*Primary Examiner*—Robert A. Hafer
*Assistant Examiner*—Jeffrey D. Carlson
*Attorney, Agent, or Firm*—H. Dennis Kelly; Timmons & Kelly

[57] ABSTRACT

A new and improved quick opening and self closing container made of a resilient rubber-like material for removably receiving large coins, keys or pieces of candy the size and shape of the well known cylindrically shaped bubble gum or of the common chocolate HERSHEY'S ® KISSES TM, coins, or the like. Said container is shaped in the form of a face with lips along the edges of its opening, giving it the appearance of a person opening its mouth when the container is opened for receiving or retrieving an object. The present invention is designed for the amusement of children and adults, and may be formed for attachment to a key chain, as a head of a doll or may be formed as a complete doll.

3 Claims, 3 Drawing Sheets

QUICK OPENING AND SELF-CLOSING CONTAINER FOR ARTICLES

BACKGROUND

This invention relates to containers for holding candy, coins and the like, and more particularly to a quick opening and self closing container for holding large coins and candy pieces the size and shape of the common cylindrically shaped bubble gum or the well known chocolate HERSHEY'S® KISSES TM, said container further being shaped to have a caricature appearance of a person's head and which may include a body for use as a doll.

The production and use of dolls and other ornaments resembling persons for providing children entertainment has been well known through the ages. Dolls and other such ornaments have included various caricature forms of people, animals and even angels. Early forms of this art included dolls made of clay and wood, which had many inherent disadvantages including that of being easily broken. Later versions included doll-like figurines made of metal, which were more durable but lacked the soft cushioney feeling desired by modern children. Modern versions of the doll have typically been made of a combination of cloth with a compressible stuffing and a resilient rubber-like material, and have been formed via the attachment of a head to a body via some sort of attaching means, some even having the head formed initially with the body as a unitary structure.

Another item that is a well known device for amusing children is the small carrying container for holding coins, keys or other such items. The use of containers for carrying such small items is well known in the art. Representative containers of this nature include the devices disclosed in U.S. Pat. Nos. 744,391 (O'Shea), 820,067 (Richardson), and Re. 24,166 (Stiller). U.S. Pat. Nos. 2,628,169 (Berthold) and 4,966,305 (Hinterreiter) illustrate the additional use of small containers for holding candy. Although the devices so disclosed were designed to accomplish a particular purpose, they would not be as suitable to accomplish the purposes of the present invention. For example, none of the containers so disclosed would be suitable to hold pieces of candy the size and shape of the cylindrical bubble gum or the chocolate HERSHEY'S® KISSES TM. As well, none of these devices would be suitable for use as a doll. Although Berthold discloses a decorative container for holding "sucker"-type confectionery, said container does not include an enclosure suitable for holding coins, keys, candy pieces which do not include a stick shaped handle, or any other such loose articles. Richardson discloses the use of a resilient container in the form of an animal, however its mouth is too small to facilitate the receiving and removal of either large coins or the size of candy pieces with which the present invention is concerned. As well, neither of the inventions disclosed in Berthold or Richardson is suitable for using as a doll. Although Hinterreiter discloses a dispenser having an attached head which gives the dispenser the appearance of having a body, the dispenser is neither suitable for holding coins or the size of candy pieces with which the present invention is concerned, nor is it suitable for use as a modern doll in that it is made of a hard or brittle plastic material rather than the resilient rubber-like and cloth materials used in most modern dolls. It is a purpose of the present invention to address these inadequacies of the prior art.

SUMMARY OF THE INVENTION

The present invention involves a quick opening and self closing container made of a resilient rubber-like material for removably receiving large coins, keys or pieces of candy the size and shape of the well known cylindrically shaped bubble gum or of the common chocolate HERSHEY'S® KISSES TM, each of said candy pieces having a diameter and height of between 1 and 3 centimeters. Said container is shaped in the form of a face with lips along the edges of its opening, giving it the appearance of a person opening its mouth when the container is opened for receiving or retrieving an object. The present invention is designed for the amusement of children and adults, and may be formed for attachment to a key chain, as a head of a doll or may be formed as a complete doll.

It is an object of the present invention to produce a container for removably receiving and holding at least a piece of candy having a diameter and a height of between 1 and 3 centimeters.

It is a further object to produce a container having the appearance of a face with a mouth that opens and closes, and into which can be removably placed at least a piece of candy or a large coin.

It is a further object to produce a container made of a resilient material suitable for use as the head of a doll.

It is a still further object to produce a doll having a mouth large enough to removably receive and hold large coins or pieces of candy, said coins or candy having a diameter and a height of between 1 and 3 centimeters.

It is a still further object to produce a hollow doll having a mouth and interior body cavity large enough to removably receive and hold large coins or pieces of candy, said coins or candy having a diameter and a height of between 1 and 3 centimeters.

To the accomplishment of the above and related objects, the present invention may be embodied in the form illustrated in the accompanying drawings. It should be noted however, that the drawings and enclosed description are illustrative only, and that changes may be made in the specific construction illustrated and described, within the scope of the appended claims.

DETAILED DESCRIPTION OF THE PREFERRED EMBODIMENTS

Figure 1:
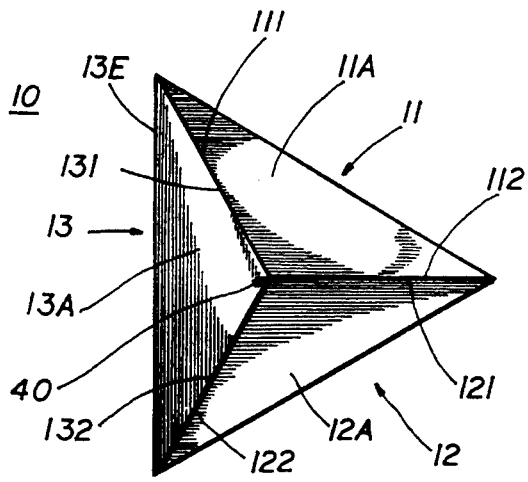
FIG. 1 is a right plan view of an embodiment of the invention.
Figure 2:
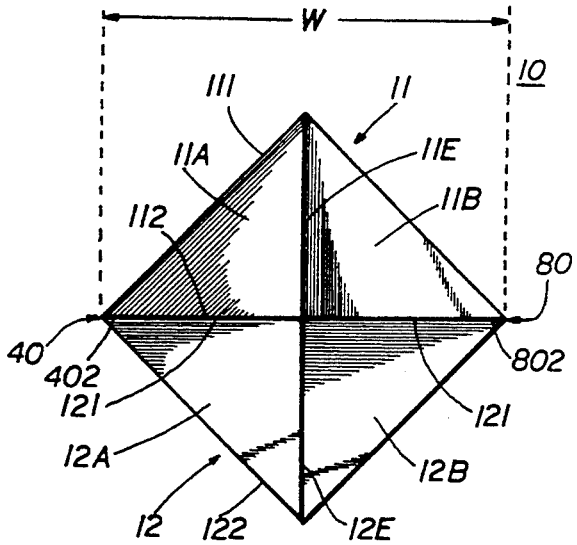
FIG. 2 is a front plan view of the embodiment of FIG. 1.
Figure 3:
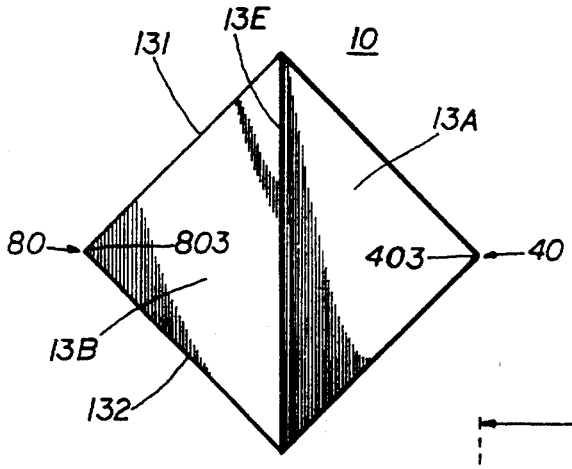
FIG. 3 is a rear plan view of the embodiment of FIG. 1.
Figure 4:
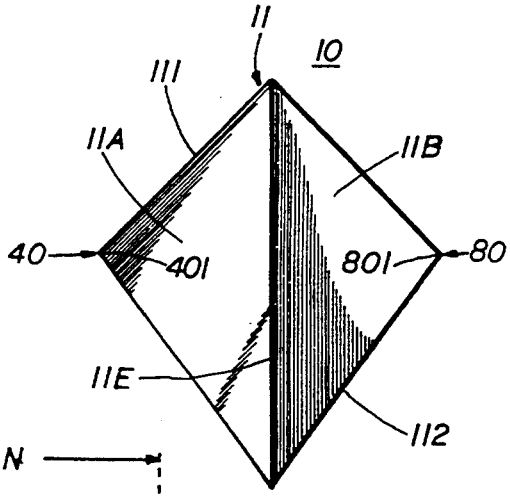
FIG. 4 is a top plan view of the embodiment of FIG. 1.

FIG'S. 1 through 6 illustrate an embodiment of the present invention. (All like numerical designations in these and the remaining figures represent the same element.) In this embodiment of the invention, a unitary hollow envelope 10 is formed by the joining of three pairs of substantially triangular surfaces at their edges, each of said triangular surfaces having an interior surface and an exterior surface. A first pair of triangular surfaces 11A and 11B are joined at a single corresponding edge 11E (FIG'S. 2 and 4) to form an upper frontal diamond surface 11. Said upper frontal diamond surface 11 has an upper edge 111 and a lower edge 112, both of said edges meeting at a first endpoint 401 (FIG. 4) and a second endpoint 801. A second pair of triangular surfaces 12A and 12B are joined at a single corresponding edge 12E (FIG. 2) to form a lower frontal diamond surface 12, having an upper edge 121 and a lower edge 122, both of said edges meeting at a first endpoint 402 (FIG. 2) and a second endpoint 802. And further, a third pair of triangular surfaces 13A and 13B are joined at a single corresponding edge 13E (FIG'S. 3 and 5) to form a rear diamond surface 13, having an upper edge 131 and a lower edge 132, both of said edges meeting at a first endpoint 403 (FIG. 3) and a second endpoint 803.

The upper frontal diamond surface 11 is affixed to the rear diamond surface 13 along the corresponding upper edges 111 and 131 which are equivalent in dimension. Likewise, the lower frontal diamond surface 12 is affixed to the rear diamond surface 13 along the lower edges 122 and 132, which are equivalent in dimension. Further, the upper frontal diamond surface 11 is removably in contact with the lower frontal surface 12 along the corresponding edges 112 and 121, which are substantially equivalent in dimension. Furthermore, all of the first endpoints 401, 402, and 403 are affixed at a first end 40 of the hollow envelope 10; and likewise, all the second endpoints 801, 802, and 803 are affixed at a second end 80 of the hollow envelope 10.

Figure 5:
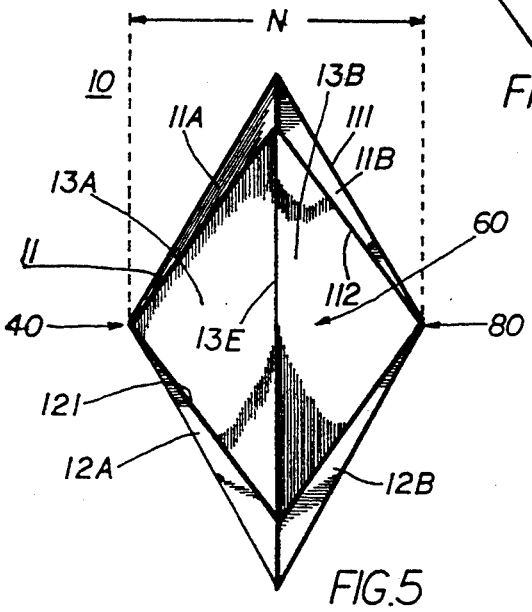
FIG. 5 is a front plan view of the embodiment of FIG. 1, with its horizontal diameter compressed revealing an opening into the container.
Figure 6:
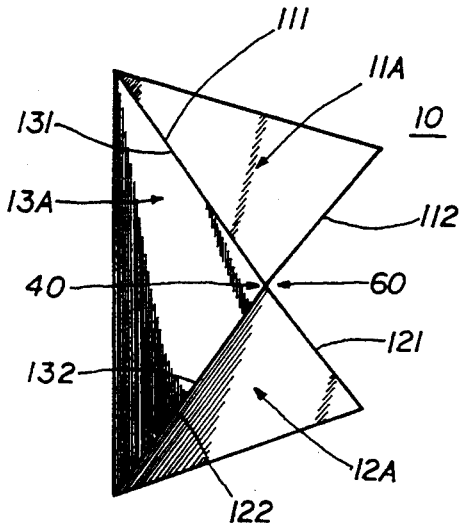
FIG. 6 is a right plan view of the embodiment of FIG. 5.

The hollow envelope 10 is made of a resilient material such as a type of rubber, a vinyl or a resilient paper, in order that the envelope 10 is compressible between the ends 40 and 80. When the envelope 10 is in a non-compressed, relaxed first state (FIG'S. 1 and 2), the corresponding edges 112 and 121 are in contact with each other, the ends 40 and 80 are separated by a first distance W, and the hollow envelope is closed 10. When two opposing forces are applied against the ends 40 and 80, the envelope 10 is moved into a compressed second state (FIG'S. 5 and 6), with the corresponding edges 112 and 121 no longer being in contact with each other, and the ends 40 and 80 being separated by a second distance N which is less than the first distance W, the hollow envelope 10 thereby having an opening 60 between the edges 112 and 121 for inserting and retrieving articles. FIG. 5 further illustrates that the interior surfaces of the substantially triangular surfaces 11A, 11B, 12A, 12B, 13A and 13B forming the hollow envelope 10 can be accessed through the opening 60.

Figure 7:
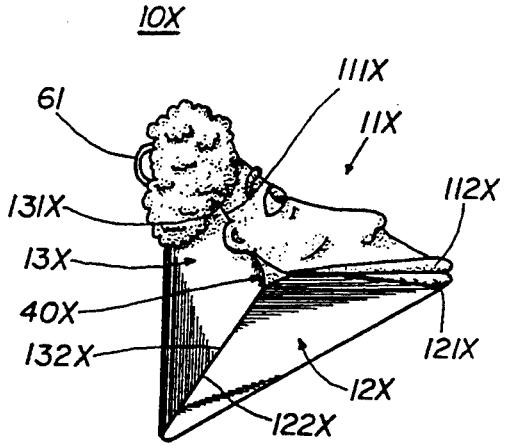
FIG. 7 is a right plan view of another embodiment of the invention having the form of a face, with a loop for attaching to a key chain or a necklace.
Figure 8:
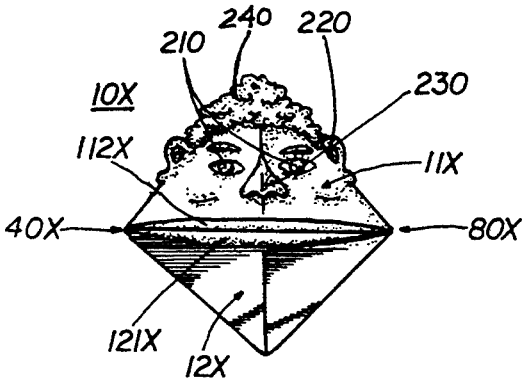
FIG. 8 is a front plan view of the embodiment of FIG. 7.
Figure 9:
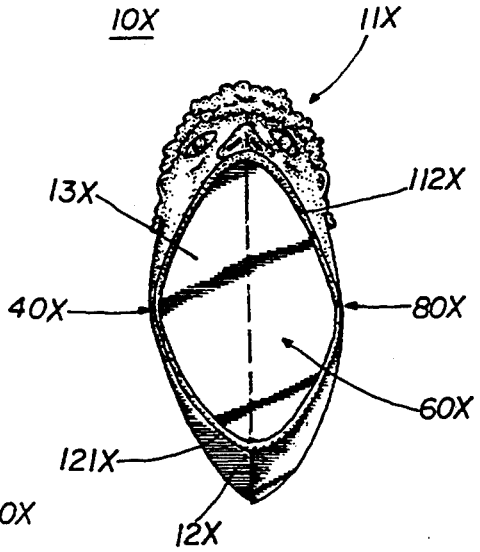
FIG. 9 is a front plan view of the embodiment of FIG. 7, with its horizontal diameter compressed revealing an opening into the container.
Figure 10:
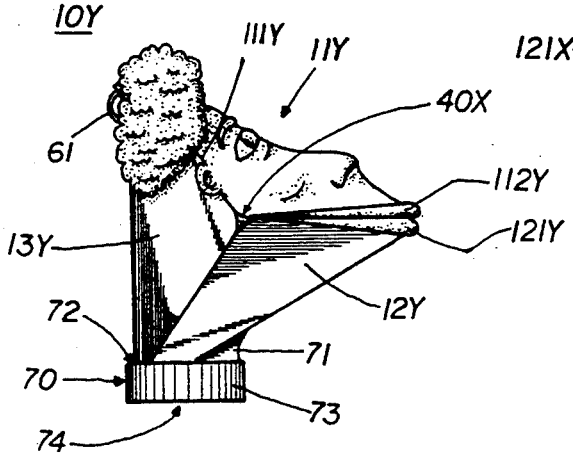
FIG. 10 is a right plan view of still another embodiment of the invention having a neck and circular flange for receiving a doll-like body.
Figure 11:
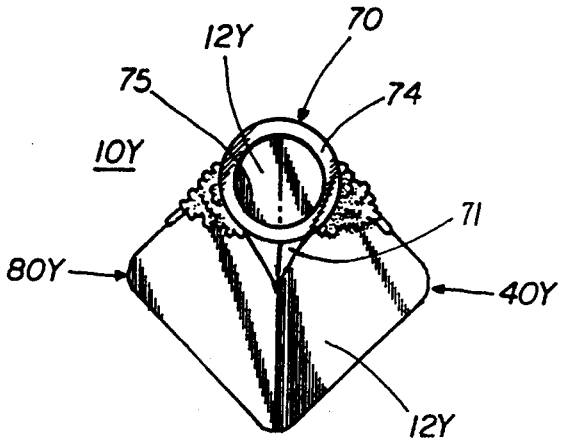
FIG. 11 is a bottom plan view of the embodiment of FIG. 10.

Another embodiment of the present invention is illustrated in FIGS. 7 through 9. In this embodiment, a unitary hollow envelope 10X is formed by joining two frontal surfaces 11X and 12X to a rear surface 13X, each of which surfaces have a substantially diamond configuration with an upper edge and a lower edge, and further having an interior and an exterior surface. Said upper and lower edges of each said surface is further connected at a first end point and a second endpoint. Both frontal surfaces are removably in contact with each other along a lower edge 112X of the upper surface and a corresponding upper edge 121X of the lower surface, said edges being substantially equivalent in dimension. Both frontal surfaces are further affixed at a first end 40X and at a second end 80X of the envelope 10X. The frontal upper surface 11X is further affixed to a rear surface 13X along an upper edge 111X of the frontal upper surface and an upper edge 131X of the rear surface, said edges being substantially equivalent in dimension. The frontal lower surface 12X is likewise affixed to the rear surface 13X along a lower edge 122X of the frontal lower surface and a lower edge 132X of the rear surface, said edges being substantially equivalent in dimension. The rear surface 13X is further affixed to the two frontal surfaces at the first end 40X and the second end 80X of the envelope.

The envelope 10X of this embodiment is likewise made of a resilient material for allowing the first end 40X and the second end 80X to be pressed toward the other, out of a relaxed first state (illustrated in FIGS. 7 and 8) into a compressed second state (illustrated in FIG. 9). When the envelope is in the compressed second state, the edges 112X and 121X are separated from the other, thereby forming an opening 60X into the envelope for receiving and retrieving articles. FIG. 5 further illustrates that the interior surfaces of the substantially triangular surfaces 11X, 12X and 13X forming the hollow envelope 10X can be accessed through the opening 60X. In this embodiment, a pair of eyes 210, a pair of ears 220, a nose 230, and a flock of hair 240 are formed on the exterior surfaces of the envelope 10X for giving the envelope 10X a caricature appearance of a person. The edges 112X and 121X are also formed in the shape of an upper lip 112X and a lower lip 121X for giving the envelope 10X an appearance of a person opening his or her mouth when the envelope is pressed into the compressed second state.

Figure 14:
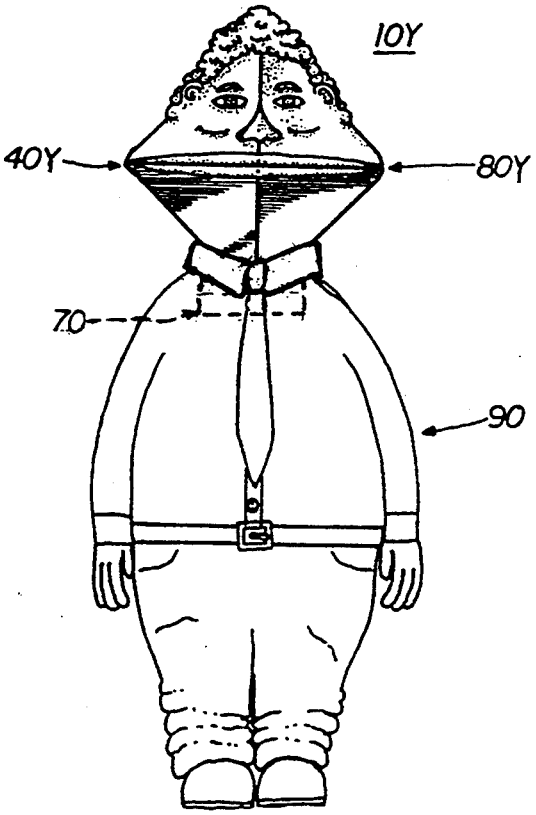
FIG. 14 is a front plan view of an embodiment of the invention affixed to a doll-like body.

FIG'S. 10, 11, and 14 illustrate another embodiment of the present invention, in which an envelope 10Y is formed similar to the envelope 10X, except that it includes a means for receiving a doll-like body 90 (FIG. 14). This embodiment is likewise formed having the caricature appearance of a person. A frontal upper surface 11Y is removably connected to a frontal lower surface 12Y between an upper lip 121Y and a lower lip 112Y. A rear surface 13Y is affixed to both frontal surfaces 11Y and 12Y, enclosing the envelope 10Y and having the appearance of a back of a person's head. A loop 61 is affixed to the rear surface 13Y for receiving a lanyard or a key ring. In this embodiment, the means for receiving a doll-like body 90 is a circular flange 70 affixed to the lower surface 12Y and the rear surface 13Y via a circular hollow neck 71. The flange 70 comprises a top shelf 72, a circumferential outer wall 73, lower shelf 74, and an interior wall 75. The flange 70 and the envelope 10Y, like the prior illustrated embodiments, are made of a resilient material, whereby the flange 70 may be compressed for inserting into a corresponding means (not shown) for receiving a flange of a doll-like body, said corresponding means being well known in the art, and the envelope 10Y may be compressed for separating the lips 112Y and 121Y thereby forming an opening into the envelope 10Y between said lips. It is preferred that the body 90 be made of a resilient material substantially similar to that of the envelope 10Y, such that said receiving means of the body 90 may flexibly cooperate with the insertion or extraction of the flange 70. However, those skilled in the art will recognize that the body 90 may just as suitably be formed of other materials, such as cloth, which are well known.

Figure 12:
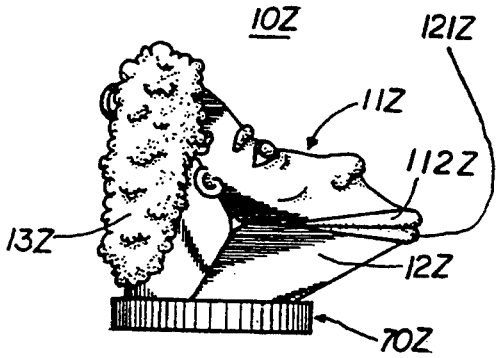
FIG. 12 is a right plan view of yet another embodiment of the invention, similar to the embodiment of FIG. 10.
Figure 13:
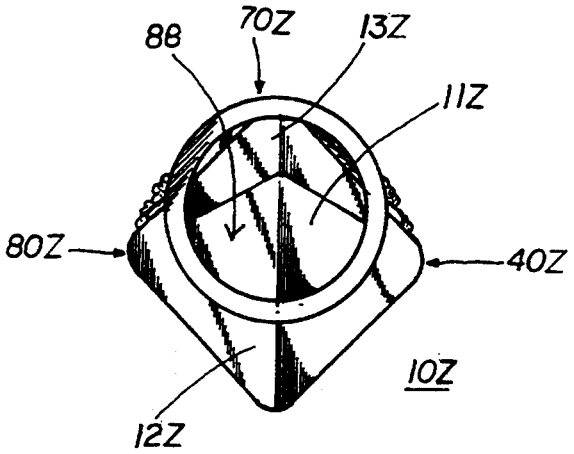
FIG. 13 is a bottom plan view of the embodiment of FIG. 12.

FIGS. 12 and 13 illustrate yet another embodiment, in which there is an opening 88 into the envelope through the circular flange 70, for allowing items inserted into the envelope between the lips 121Y and 112Y to travel through the opening 88 into the attached hollow doll-like body 90. In this form, the doll-like body 90 has a hollow interior cavity (not illustrated) which is sufficiently large for receiving and holding large coins and pieces of candy. The doll-like body is thus an integral part of the container for articles, in that the articles are actually stored within the body, rather than solely within the envelope. Although FIGS. 10 through 13 illustrate a means for receiving a doll-like body, the forms of the present invention which include a doll-like body may be made with the hollow envelope 10Y initially formed as part of a unitary structure with and of the same material as the doll-like body 90.

While the quick opening and self closing container of this invention has been described with reference to illustrative embodiments, this disclosure is not intended to be construed in a limiting sense. Various modifications and combinations of the illustrative embodiments of this invention will be apparent to persons skilled in the art upon reference to this description. These may include but not be limited to the use of alternate face, hair and body styles, including those of both genders and a variety of animal-like caricatures, as well as the use of various materials in the construction of the present invention. It is therefore contemplated that the appended claims cover any such modifications and embodiments as fall within the true scope of the invention.

I claim:

1. A quick opening and self closing container for articles, comprising:

a unitary hollow envelope of resilient material, said envelope having a pair of upper frontal surfaces, a pair of lower frontal surfaces, and a pair of rear surfaces;

each of said surfaces being of substantially triangular configuration and joined along an edge to form an upper frontal diamond surface, a lower frontal diamond surface and a rear diamond surface, wherein at least a part of said upper and lower frontal diamond surfaces are shaped to form a face, giving the container an appearance similar to that of a head, and having a lip along the entire length of each of the edges between the upper and lower frontal surfaces;

each diamond surface having an upper edge and a lower edge connected at a first end point and a second end point;

said upper frontal diamond surface being joined along its upper edge to the corresponding upper edge of said rear diamond surface;

said lower frontal diamond surface being joined along its lower edge to the corresponding lower edge of said rear diamond surface;

said upper front diamond surface further being in removable contact along its lower edge with the corresponding upper edge of said lower frontal diamond surface;

all of said first end points of said edges being joined to form a first end of the envelope, and all of said second end points being joined to form a second end of the envelope;

said envelope further being compressible between the first and second ends of the envelope, so that when the envelope is in non-compressed relaxed first state the envelope ends are separated by a first distance, and when the envelope is in a compressed second state the envelope ends are separated by a second distance which is less than the first distance, and the lower edge of the upper frontal diamond surface is separated from the corresponding upper edge of the lower frontal diamond surface to form an opening in the envelope for receiving articles; and wherein a doll-like body, made of the same resilient material as the container, is affixed to the container, wherein the doll-like body is hollow and there is an opening between the envelope and the doll-like body for allowing items received into the envelope to travel through said opening into the hollow doll-like body.

2. A quick opening and self closing container for articles, comprising:

a unitary hollow envelope having a frontal upper surface, a frontal lower surface, and a rear surface;

each frontal surface having a substantially diamond configuration with a lower edge and an upper edge, said edges being connected at a first end point and a second end point forming a first end and a second end of the frontal surface;

each of said frontal surfaces further being in removable contact with the other frontal surfaces along the lower edge of the upper surface and the corresponding upper edge of the lower surface between the first end point and the second end point of each surface;

said frontal surfaces further being made in the form of a face having an upper lip along the lower edge of the upper surface and a lower lip along the upper edge of the lower surface;

said rear surface having a substantially diamond configuration with an upper edge and a lower edge, said edges being connected at a first end point and a second end point forming a first end and a second end of the rear surface;

said rear surface further being connected to the upper frontal surface along the upper edge of the rear surface and the corresponding upper edge of the upper frontal surface between the first end and the second end of each surface, the rear surface further being connected to the lower frontal surface between the lower edge of the rear surface and the corresponding lower edge of the lower frontal surface, between the first end and the second end of each surface said rear surface further being formed such that said rear surface has an appearance similar to the back of a person's head;

each envelope surface further being connected to both of the other envelope surfaces at the first and second ends of each surface, thereby forming a first end and a second end of the envelope;

said envelope surfaces further being formed of a resilient material so that the first and second envelope ends may be moved toward the other end by exerting an external pressure on each end, and thereby separating the lower edge of the frontal upper surface from the upper edge of the frontal lower surface forming an opening into the container between the upper and lower frontal surfaces, giving an appearance that the envelope face is separating its lips to open its mouth;

said hollow envelope and opening being large enough for removably receiving at least a piece of candy having a diameter of between 1.5 to 3 centimeters; and a doll-like body affixed to the envelope such that the envelope has the appearance of being the head of said doll-like body, wherein the doll-like body is hollow and there is an opening between the envelope and the doll-like body for allowing items received into the envelope to travel through the opening into the hollow doll-like body.

3. A quick opening and self closing container for articles, comprising:

a unitary hollow envelope of resilient material, said envelope having a pair of upper frontal surfaces, a pair of lower frontal surfaces and a pair of rear surfaces;

each of said surfaces being of substantially triangular configuration and joined along an edge to form an upper frontal diamond surface, a lower frontal diamond surface and a rear diamond surface;

each diamond surface having an upper edge and a lower edge connected at a first end point and a second end point;

said upper frontal diamond surface being joined along its upper edge to the corresponding upper edge of said rear diamond surface;

said lower frontal diamond surface being joined along its lower edge to the corresponding lower edge of said rear diamond surface;

each of said upper and lower frontal surfaces further being shaped to form a face giving the container an appearance similar to that of a head, and having a lip along the entire length of each of the edges between the upper and lower frontal surfaces;

said upper frontal diamond surface further being in removable contact along its lower edge with the corresponding upper edge of said lower frontal diamond surface;

all of said first end points of said edges being joined to form a first end of the envelope, and all of said second end points being joined to form a second end of the envelope;

said envelope further being compressible between the first and second ends of the envelope, so that when the envelope is in a non-compressed relaxed state the envelope ends are separated by a first distance and the lip, and when the envelope is in a compressed second state the envelope ends are separated by a second distance which is less than the first distance, and the lower edge of the upper frontal diamond surface is separated from the corresponding upper edge of the lower frontal diamond surface to form an opening in the envelope for receiving articles; and a hollow doll-like body made of the same resilient material as the envelope and affixed to at least one of the lower frontal and rear diamond surfaces, said doll-like body being in communication with the envelope through an opening between the doll-like body and the envelope, for allowing items received into the envelope to travel through said opening into the doll-like body.

* * * * *